US006520482B1

(12) United States Patent
Bigham

(10) Patent No.: US 6,520,482 B1
(45) Date of Patent: Feb. 18, 2003

(54) LIFTING APPARATUS FOR A MANHOLE COVER

(76) Inventor: Vern Bigham, 354 Forest La., Mankato, MN (US) 56003

( * ) Notice: Subject to any disclaimer, the term of this patent is extended or adjusted under 35 U.S.C. 154(b) by 0 days.

(21) Appl. No.: 10/012,897

(22) Filed: Nov. 5, 2001

(51) Int. Cl.[7] ..... B66F 3/00
(52) U.S. Cl. ..... 254/131; 294/17
(58) Field of Search ..... 254/131, 120, 254/8 R; 296/17; 414/689.3, 444, 494; 294/18, 15; 280/47.27

(56) References Cited

U.S. PATENT DOCUMENTS

| | | | | | |
|---|---|---|---|---|---|
| 1,427,576 | A | | 8/1922 | Bryant | |
| 3,985,338 | A | | 10/1976 | Herrmann | |
| 4,157,810 | A | | 6/1979 | Haller et al. | |
| 4,365,786 | A | | 12/1982 | Osteen | |
| 4,488,706 | A | * | 12/1984 | Kono | 254/131 |
| 4,612,730 | A | | 9/1986 | Gundy | |
| 4,621,941 | A | | 11/1986 | Ditcher et al. | |
| 4,695,037 | A | * | 9/1987 | Hadbavny | 254/131 |
| 4,793,646 | A | * | 12/1988 | Michaud | 294/19.1 |
| 4,852,855 | A | * | 8/1989 | Moisan | 254/131 |
| 4,991,893 | A | * | 2/1991 | Gordon | 294/17 |
| 5,165,661 | A | * | 11/1992 | Wright | 254/131 |
| 5,431,459 | A | | 7/1995 | Gundy | |
| 5,462,385 | A | * | 10/1995 | Mohlengraft | 404/25 |
| 5,531,541 | A | | 7/1996 | Clover et al. | |
| 5,674,045 | A | | 10/1997 | Eckloff et al. | |
| 5,775,674 | A | * | 7/1998 | Bigham | 254/131 |
| 5,865,425 | A | | 2/1999 | Meadows | |
| 5,947,633 | A | | 9/1999 | Foss | |
| 6,176,469 | B1 | * | 1/2001 | Bigham | 254/131 |
| 6,202,985 | B1 | * | 3/2001 | Chong | 254/131 |
| 6,209,936 | B1 | * | 4/2001 | Radke | 294/17 |

* cited by examiner

*Primary Examiner*—Joseph J. Hail, III
*Assistant Examiner*—Daniel Shanley
(74) *Attorney, Agent, or Firm*—Kinney & Lange, P.A.

(57) ABSTRACT

A portable apparatus for displacing a manhole cover from a manhole where the manhole cover includes an engaging surface where the portable apparatus includes a leg having a first end and a second end and a shaft attached to the first end of the leg such that the leg and the shaft define a fulcrum point for the device. A tool is attached to the engaging portion wherein the tool engages the engaging surface of the manhole cover.

22 Claims, 5 Drawing Sheets

LIFTING APPARATUS FOR A MANHOLE COVER

BACKGROUND OF THE INVENTION

The present invention relates to a lift apparatus for lifting a manhole cover. More particularly, the present invention relates to a portable manually operated manhole cover-engaging tool.

Utility covers, also known as "manhole" covers, are frequently used to cap entrances to subsurface enclosures. For example, manhole covers are often used to cover the openings to sanitary and storm sewers, subsurface telephone cable and communication line junction boxes, electrical enclosures, and enclosures providing access to subterranean pipes.

Most manhole covers are constructed of thick metal, commonly steel, and are often very heavy usually weighing over 50 pounds. The great strength and weight of manhole covers serve a number of purposes, including preventing unauthorized access to the enclosure by children or other persons, preventing inadvertent movement and displacement of the manhole cover by vehicles, and providing a solid base for people and transportation equipment traveling over the manhole.

However, the weight of manhole covers also poses a significant problem to their use because they are difficult and sometimes hazardous to remove. The fact that manhole covers are usually heavy, combined with the fact that they are usually positioned at ground level, means that a worker trying to remove a manhole cover usually attempts to lift the heavy manhole cover from a bent-over position. This bent-over lifting position can lead to back injuries, which result in pain and suffering. These injuries also cause lost productivity and income for employees and employers.

A conventional method of removing manhole covers is to pry the edge of the manhole cover upward with a pick, and then rotate the cover away from the opening with either the pick or another tool, such as a shovel or pry-bar. Conventional removal methods often require that the worker removing the cover grab the edge of the cover. Grabbing a manhole cover can be very hazardous, because workers risk crushing their fingers under the weight of the cover or severely pinching their fingers between the cover and the rim of the manhole. Also, use of the hands usually means that the worker is bent over the manhole, providing additional concern about back injury.

Conventional apparatuses and methods of opening manholes also pose the problem that the worker must be relatively close to the manhole while removing the cover. The proximity of the worker to the manhole can be problematic because manholes are often very deep, and falling into an open manhole can cause severe injuries or even death. Under some circumstances, such as overflowing sewers or ruptured water mains, water may be leaking out of the top of the manhole, creating a slippery, wet surface proximate the manhole opening. This slippery surface can be especially troubling during winter when ice forms proximate the manhole. Therefore, it is desirable for a manhole opener to permit the removal of the manhole cover while the worker is a safe distance from the opening.

A further problem associated with removing manhole covers is that not all manhole covers can be removed in the same manner. Some covers have a small round opening in the middle of the cover. Other manhole covers have a slot or depression on the outer edge of the cover, while still others have one or more slots, holes, or depressions positioned at the edge of the manhole cover or between the edge and the center of the manhole cover. These various configurations can be a challenge to open, and may require specialized tools for each manhole cover.

Another problem associated with removing manhole covers is the difficulty in replacing the manhole cover. Under a conventional method, a pick is used to pry up the edge of the cover, which is then manually flipped up onto its side, rolled over to the opening, and then slowly rotated into place. This is a tedious and somewhat difficult task because of the great weight of the cover. Also, two people are often required to easily replace the manhole cover, the first to pry the edge off the ground, and the second to flip the manhole cover into a vertical position and roll it into place.

Accordingly, there is a need for an apparatus and method for safely, easily, and efficiently removing and replacing a manhole cover. Even further, there is a need for an apparatus which permits one person to remove and replace a manhole cover with a minimum of stress and danger, and a reduced risk of injuries to hands, feet, and backs.

BRIEF SUMMARY OF THE INVENTION

The present invention includes a portable apparatus for removing a manhole cover from a manhole where the manhole cover includes an engaging surface. The portable apparatus has a leg having a first end and a second end and a shaft attached to the first end of the leg such that the leg and the shaft define a fulcrum point. A tool is attached to the second end of the leg wherein the tool engages the engaging surface of the manhole cover thereby allowing the manhole cover to be lifted.

DETAILED DESCRIPTION

Figure 1:
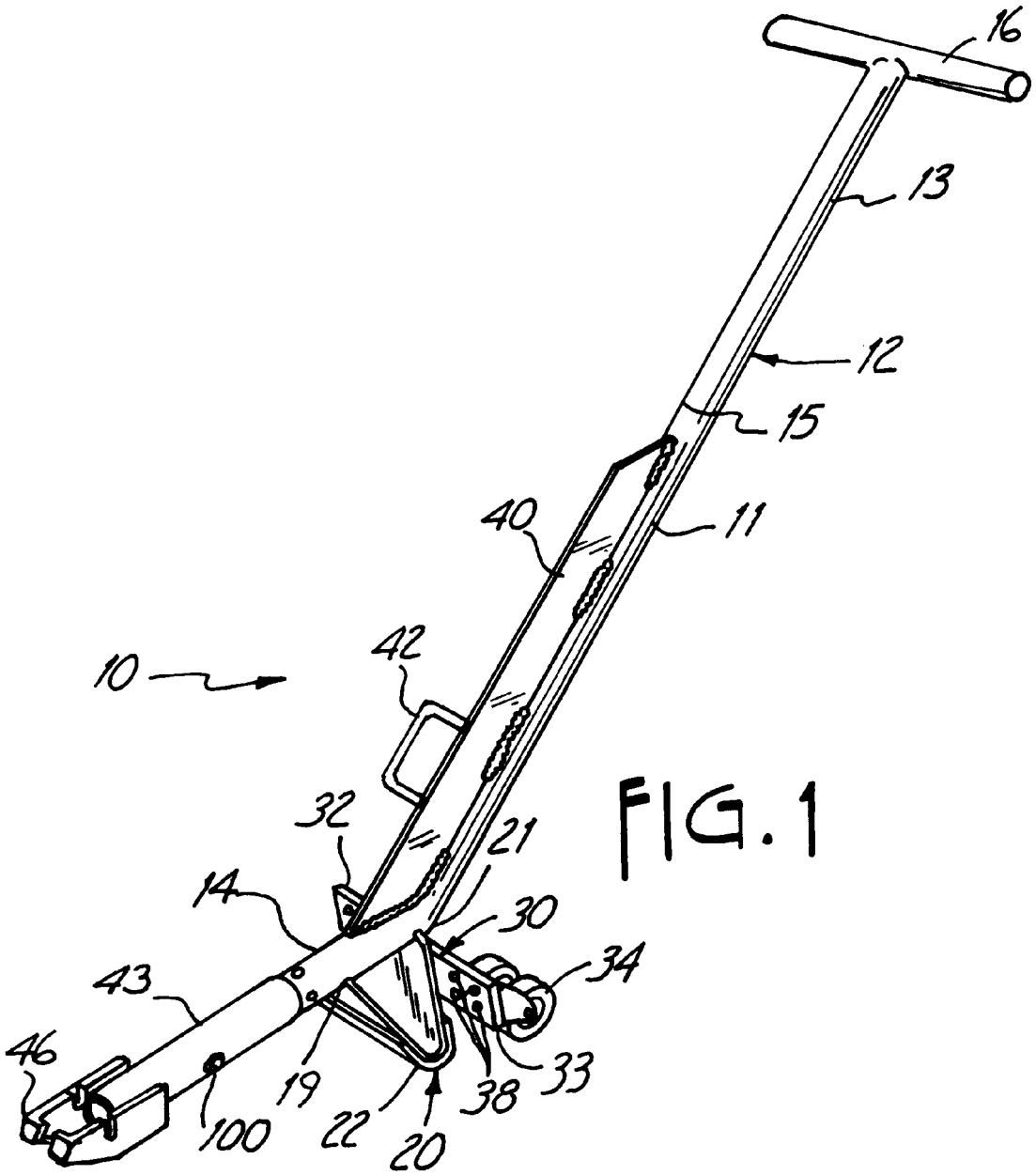
FIG. 1 is a perspective view of the lifting apparatus of the present invention having a tool engaging member attached thereto.
Figure 2:
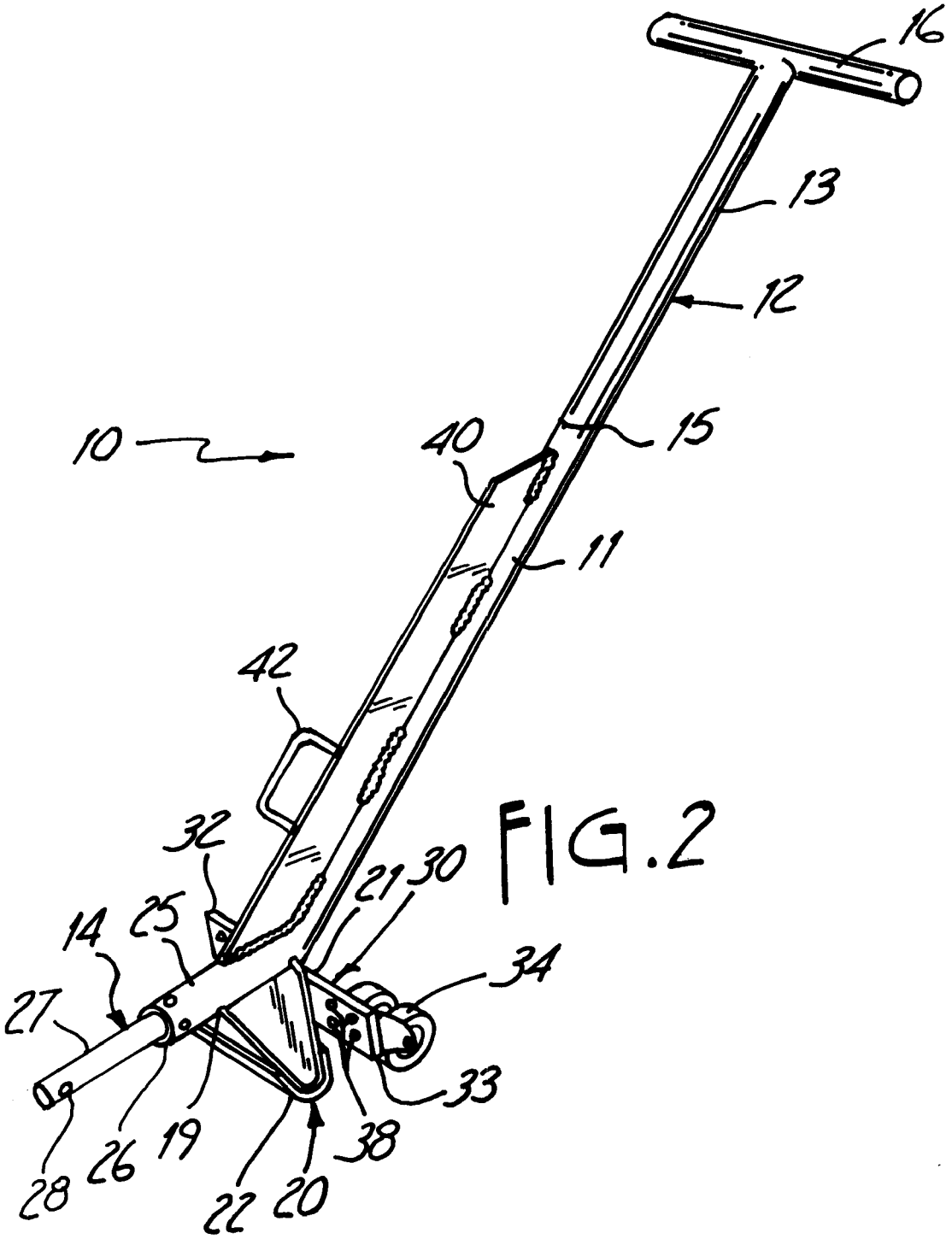
FIG. 2 is a perspective view of the lifting apparatus of the present invention.
Figure 3:
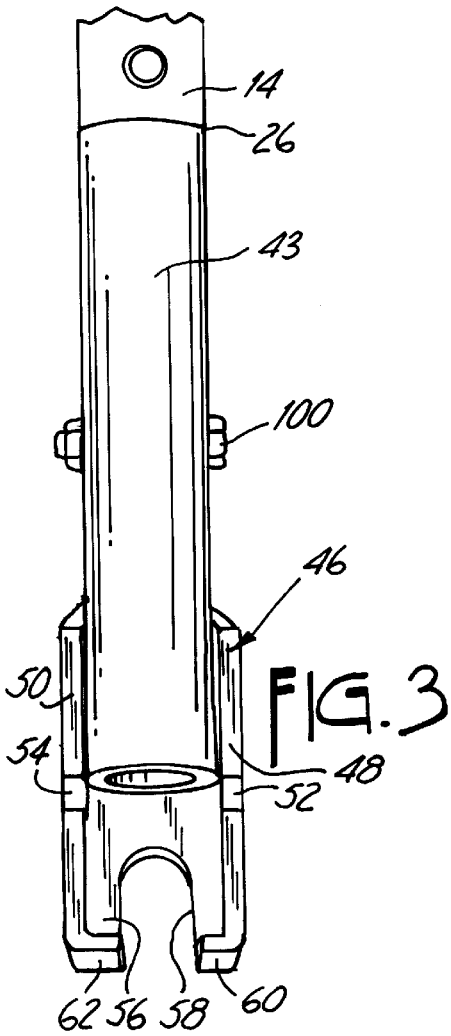
FIG. 3 is a front view of the tool engaging member of the present invention.

A portable manhole cover lifting apparatus of the present invention is illustrated in FIGS. 1 and 2 generally at 10. The manhole cover lifting apparatus 10 includes a leg 14 attached to a shaft 12 wherein the shaft 12 and the leg 14 create an obtuse angle.

Referring to FIG. 2, the leg 14 preferably has a circular cross-section, although other cross-sectional geometries are within the scope of the present invention. The leg 14 has a first diameter 25 proximate a first end and second diameter 27 proximate a second end. The difference between the first and second diameters 25 and 27 defines a shoulder 26. Proximate the second end of the leg 14 are a set of aligned apertures 28.

Figure 4:
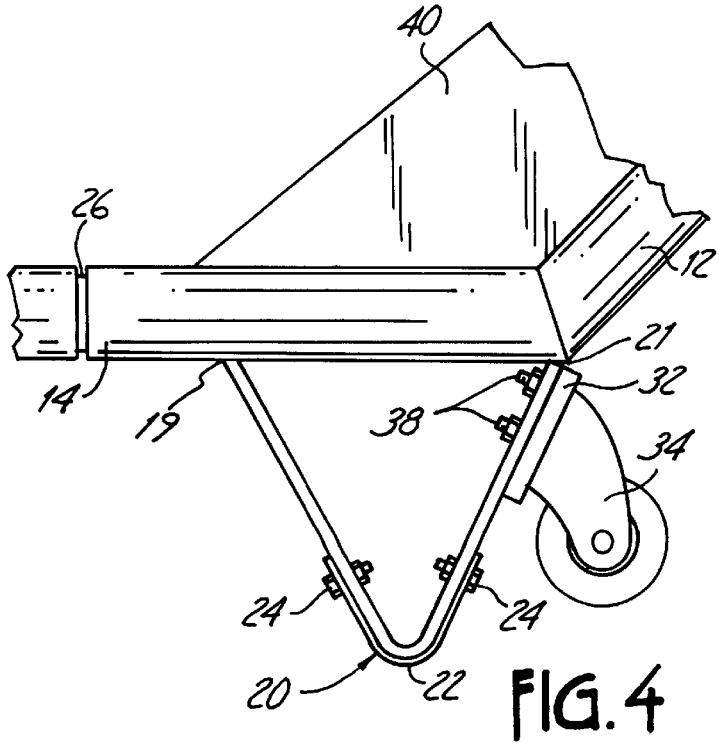
FIG. 4 is a side view of the surface engaging member of the present invention.

Referring to FIGS. 1, 2 and 4, a surface engaging member 20 is attached to the leg 14 proximate a pivot point or fulcrum point defined by the attachment of the shaft 12 to the leg 14. The surface engaging member 14 preferably has an arcuate shape wherein a first end 19 and a second end 21 are attached to a bottom portion of the leg 14.

The lifting apparatus 10 is preferably made of aluminum to minimize the weight of the lifting apparatus 10 although other materials of construction are within the scope of the present invention. Aluminum provides enough strength to lift and maneuver a manhole cover (not shown) while being substantially lighter than steel. In the preferred embodiment, the lifting apparatus 10 weighs approximately 8 pounds.

Because the surface engaging member 20 is made of aluminum, the aluminum has a tendency to erode with the use of the lifting apparatus 10. In order to minimize the erosion of the aluminum from the surface engaging member 20, a steel plate 22 is attached to the engaging surface of the surface engaging member 20, preferably by a plurality of bolts 24 or rivets.

Figure 5:
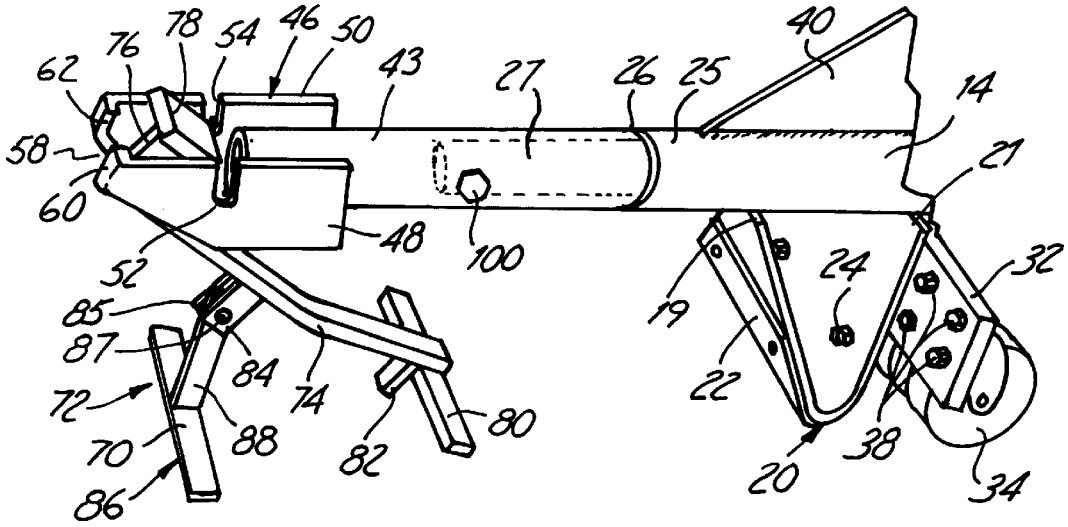
FIG. 5 is a partial perspective view of the lifting apparatus of the present invention having a grate engaging member attached thereto.

Referring to FIGS. 4 and 5, a wheel assembly 30 is attached to the arcuate surface engaging member 20 proximate the second end 21. The wheel assembly 30 includes a support member 32 which extends beyond outer edges of the surface engaging member 20. A first set of wheels 34 is attached to the support member 32 proximate a first end 33 preferably by a plurality of bolts 38 inserted through a plurality of apertures (not shown) in the support member 32. Similarly, a second set of wheels 36, is attached to the support member 32 proximate a second end 35 of the support member 32 also preferably by a plurality of bolts 38 inserted through a plurality of apertures (not shown) in the support member 32.

Referring to FIGS. 1 and 2, a fillet 40 is attached to both the leg 14 and the shaft 12 along the point of attachment of the leg 14 to the shaft 12 where the fillet 40 conforms to the obtuse angle. The fillet 40 provides strength and structural integrity to the lifting apparatus 10. A second handle 42 is attached to an outer edge of the fillet 40. Because the lifting apparatus 10 of the preferred embodiment weighs about 8 pounds, the second handle 42 allows the operator of the lifting apparatus 10 to easily carry the apparatus 10 from location-to-location.

A first handle 16 is attached to a second end of the shaft 12 in a substantially perpendicular configuration. The shaft 12 is centrally located on the first handle 16 and the first handle 16 is in a substantially orthogonal relationship with the leg 14.

Preferably the shaft 12 includes a lower section 11 and an upper section 13. The upper section 13 telescopes within a through bore in the lower section 11 such that a length of the shaft 12 is adjustable. The telescoping feature of the shaft 12 is especially useful in shortening the length of the tool 10 for transporting and storing the tool 10.

The upper portion 13 has an outward extending flange (not shown) at an end which cooperates with an inward extending flange (not shown) at an end 15 of the lower section 13. The cooperation of the flanges (not shown) slidably retains the upper section 13 within the lower section 11. Although a telescoping shaft 12 is preferred, one skilled in the art will appreciate that a shaft 12 of a fixed length is also within the scope of the invention.

Referring to FIGS. 1, 3, 5 and 6, a tool engaging member 43, having a complimentary cross-section to the cross-section of the leg 14, is disposed over the second end of the leg 14 until an end of the tool engaging member 43 is adjacent to the shoulder 26 of the leg 14. The tool engaging member 43 also includes aligned apertures (not shown) which cooperate with the apertures 28 within the leg 14 such that a pin 100 is inserted through the apertures thereby securing the tool engaging member 43 to the leg 14.

A U-shaped member 46 is attached to a distal end of the tool engaging member 43. First and second side walls 48, 50 of the U-shaped member 46 include slots 52, 54 extending from a top surface thereof. The slots 52, 54 are designed to accept links of a chain 70. A bottom web 56 of the U-shaped member 46 includes a channel 58. Extending inwardly from ends of the first and second side walls 48, 50 are first and second stop members 60, 62. The stop members 60, 62 are spaced apart the same distance as the width of the channel 58. The stop members 60, 62 prevent tools from accidentally slipping off of the U-shaped member 46.

Figure 6:
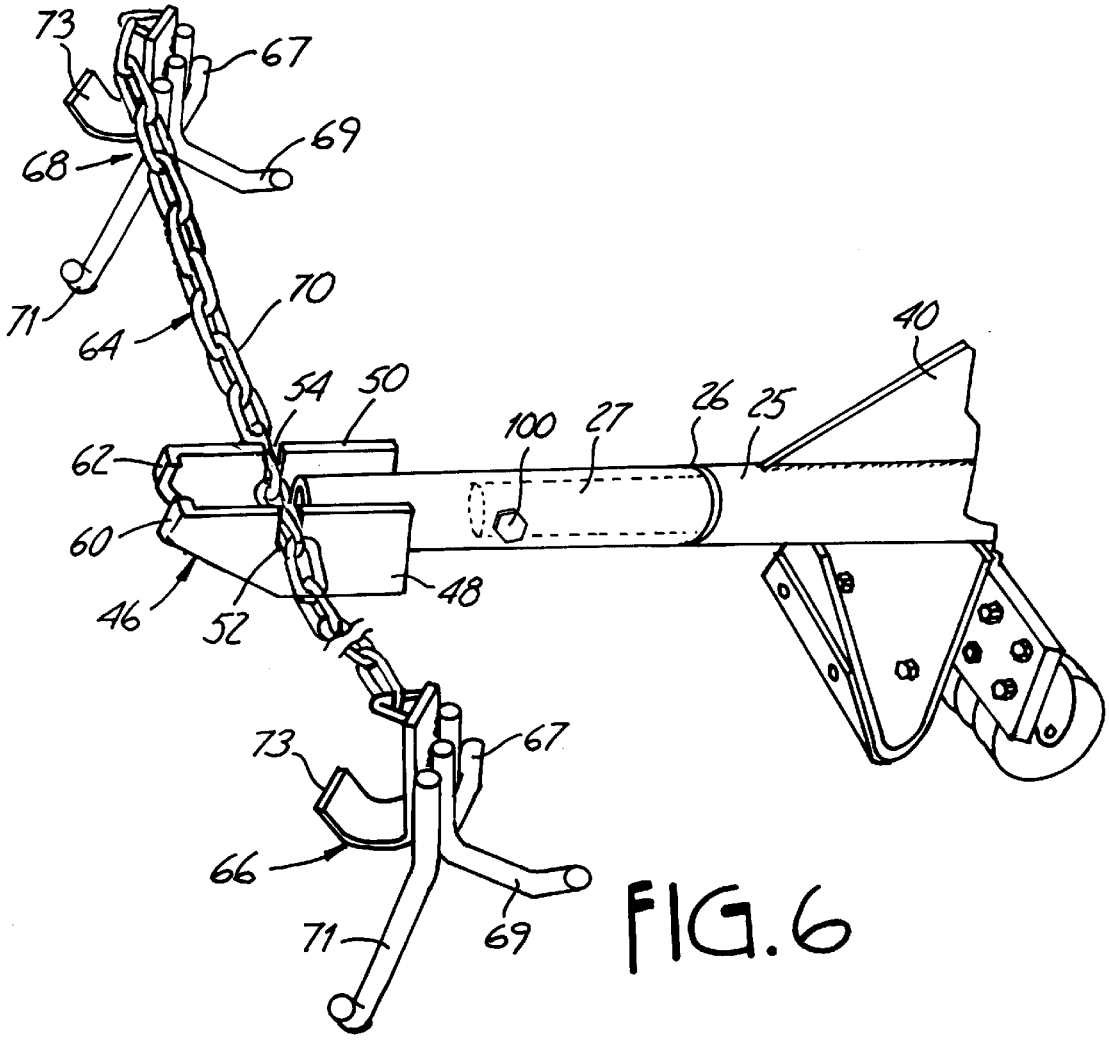
FIG. 6 is a partial perspective view of the lifting apparatus of the present invention having a hook tool attached thereto.

Referring to FIGS. 5 and 6, the U-shaped member 46 is adapted to engage several engaging tools including a hook tool 64 as well as the tools having a plate which fits between the side wall 48, 50 and contacts the bottom web 56 and a member which extends from the plate through the channel. Examples of tools having a plate and an extension are disclosed in U.S. Pat. No. 6,176,469B1, which is hereby incorporated by reference, one tool of which is a grate engaging tool 72 as illustrated in FIG. 5.

The hook tool 64 includes a first hook member 66 and a second hook member 68 connected by a chain 70. Links of the chain 70 are vertically disposed into the first and second slots 52, 54 in the side walls 48, 50 of the U-shaped member 46 thereby securing the hook tool 64 to the U-shaped member 46. Each of the hook members 66, 68 includes four hooks 67, 69, 71, 73 of different sizes and configurations thereby allowing the same hook members 66, 68 to engage different surfaces within the manhole cover. The hook tool 64 is especially useful to lift covers which have spaced apart first and second slots or apertures along an axis of the cover. Concrete covers which access telecommunications equipment typically have spaced apart engaging surfaces or first and second slots 52, 54 along the axis of the cover for which the hook tool 64 is useful.

Referring to FIG. 5, another tool 72 is useful in engaging grates, especially water run off grates and storm sewer grates. The grate engaging tool 72 is disclosed in U.S. Pat. No. 6,176,469B1 and includes a main member 74 having a first end and a second end. Attached to an upper surface of the main member 74, proximate the first end, is an extension 76 extending substantially perpendicularly away from the main member 74. A plate 78 is attached to the member wherein the plate 78 and the main member 74 are substantially parallel.

Attached to the second end of the main member 74 is a cross member 80. The cross member 80 is substantially perpendicular to the main member 74 and the main member 74 is attached to the cross member 80 at its midpoint.

Extending from a bottom surface of the cross member 80 is a stabilizing member 82. The stabilizing member 82 is substantially centrally located on the cross member 80 in an orthogonal relationship with the main member 74 and parallel to the extension 76.

Extending downwardly from the main member 74 are a first attaching member 84 and a second attaching member 86. The first attaching member 84 includes a first aperture (not shown). The second attaching member 86 includes a second aperture (not shown) aligned with the first aperture. The first attaching member 84 and the second attaching member 86 are substantially centrally located between the first end and the second end.

A T-shaped member 86 is pivotally-attached to the first and second attaching member 84. A pin 87 is inserted through the first aperture (not shown) in the first attaching member 84, an aperture (not shown) in a vertical member 88 of the T-shaped member 86 proximate a first end, and the second aperture (not shown) in the second attaching member 84 thereby pivotally attaching the vertical member 88 to the main member 74.

Attached to the second end of the vertical member 88 is a grate engaging member 90. The grate engaging member 90 is in a substantially perpendicular relationship to the vertical member 88. Preferably, the vertical member 88 is attached to the grate engaging member 90 by a weld substantially half way between a first end and a second end.

Figure 7:
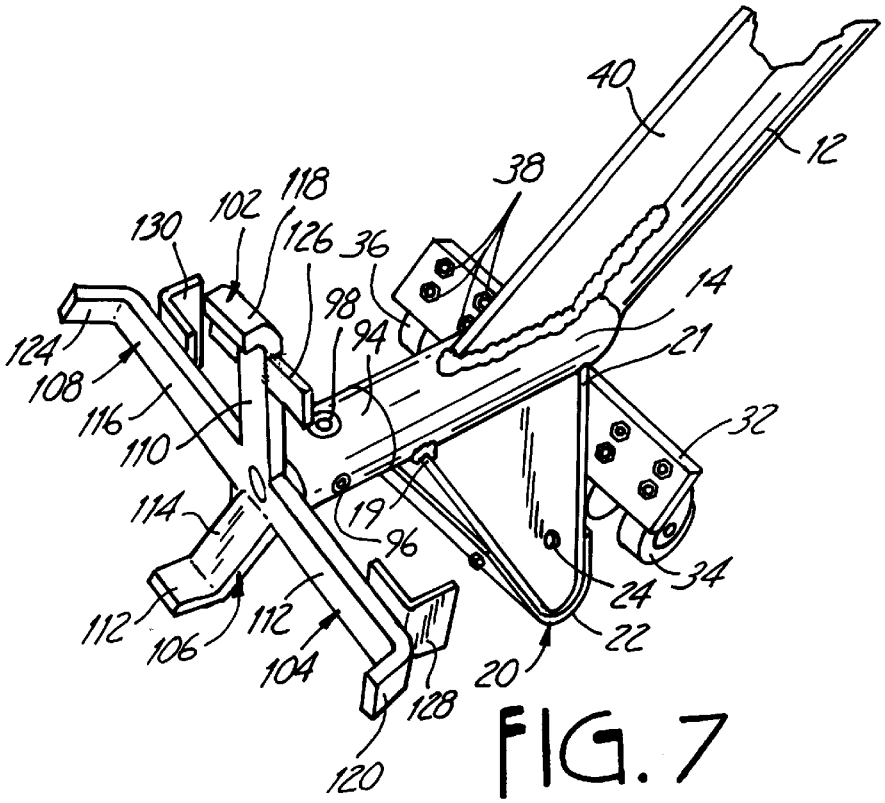
FIG. 7 is a partial perspective view of the lifting apparatus of the present invention having an X-shaped tool attached to thereto.
Figure 8:
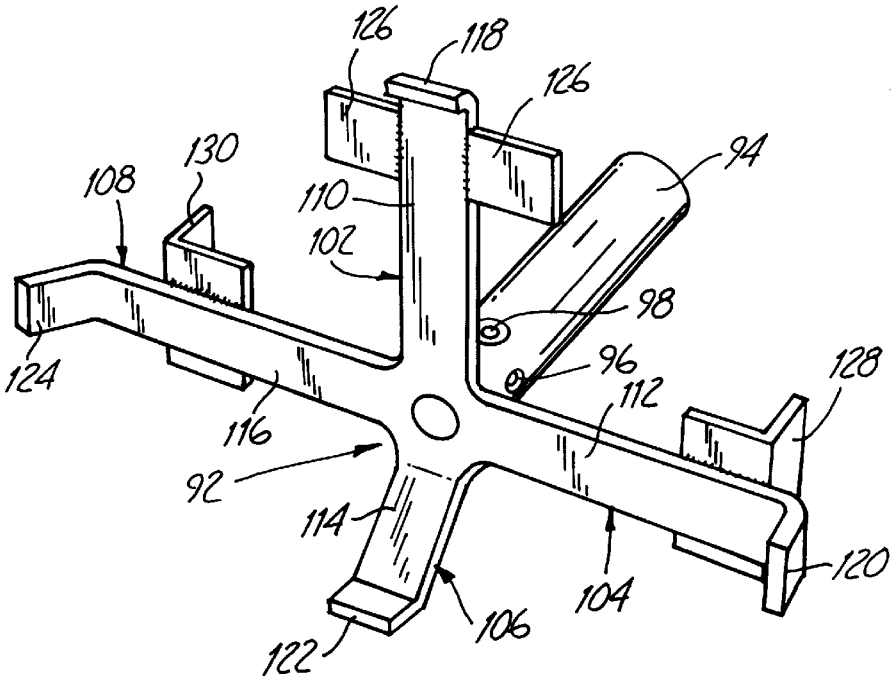
FIG. 8 is a perspective view of the X-shaped member of the present invention.

Instead of attaching the tool engaging member 43 to the leg, an alternative embodiment includes an X-shaped tool 92 having a pipe 94 extending from the intersection of the X-shaped tool 92 which is attached to the leg 14 as illustrated in FIG. 7. The pipe 94 has a complimentary configuration to the leg 14 wherein an end of the pipe 94 extends up to the shoulder of the leg 14. One skilled in the art will recognize that other cross-sectional configurations of the pipe 94 and the leg 14 besides a circular cross-section are within the scope of the invention. The pipe 94 has two sets of aligned apertures 96, 98 that are perpendicular to each other. The set of apertures 96, 98 are in the same plane as two sets of members 102, 106, 104, 108 defining the X-shape.

The members 102, 104, 106,108 of the members of the X-shape are 90° away from each other wherein each member 102, 104, 106, 108 of the X-shape has a straight portion and an inwardly angled portion 118, 120, 122, 124, respectively, adapted to receive and engage different surfaces within the manhole cover. The X-shaped tool 92 is designed to engage apertures spaced a distance from a center of gravity of the manhole cover.

To securely lift manhole covers with an engaging surface spaced a distance from the center of gravity, three of the four members of the X-shaped tool 92 have a brace 126, 128, 130 which engages an upper surface of a manhole cover. One of the braces 126 is even with a front surface of the member 102. With the front surface of the brace 126 even with the front surface of the member 102, the X-shaped tool 92 is able to engage and lift a manhole cover where the engaging surfaces extend inward from a rim of the manhole cover that a brace 128, 130 positioned behind the member 104, 106 would not be able to contact the manhole cover. The braces 126, 128, 130 retain the manhole cover on the member 102, 104, 106 by preventing the manhole cover from pivoting about the member 102, 104, 106. One skilled in the art will recognize that a member 108 without a brace is necessary to engage thick manhole covers where a brace may interfere with the member 108 securely engaging the manhole cover. In these instances, the thickness of the cover prevents the cover from pivoting about the member.

In operation, either the tool engaging member 43 or the X-shaped tool 92 are positioned on the leg 14 and the pin 100 is inserted through the aligned apertures to secure either the tool engaging member 43 or the X-shaped tool 92 to the leg 14. The design and type of tool for engaging the manhole cover is dependent upon the location and style of the aperture or apertures within the manhole cover. A manhole cover is being used for purposes of illustration although other objects such as a runoff grate or concrete cover could also be used to illustrate the invention in operation. Once the proper tool for engaging the aperture in the manhole cover is determined, the appropriate tool 43 or 92 is secured to the leg 14.

With the appropriate manhole engaging tool 43 or 92 secured to the lifting apparatus 10, the lifting apparatus 10 is positioned on a surface near the manhole cover. The lifting apparatus 10 can either be wheeled into a position such that the engaging tool 43 or 92 engage the aperture within the manhole cover or because of the lightweight nature of the lifting apparatus 10, the lifting apparatus 10 can be carried proximate the manhole cover with the second handle 42. The manhole cover engaging tool 43 or 92 is positioned within the aperture of the manhole cover and the apparatus 10 is rotated or pivoted on the surface engaging member 20 until the tool 43 or 92 is secured within the aperture within the manhole cover.

With the tool 43 or 92 secured within the aperture in the manhole cover, a downward force is applied to the first handle 16 which in turn applies an upward force on the manhole cover engaging tool 43 or 92. The upward force applied by the tool 43 or 92 on the manhole cover is proportionally greater than the downward force applied to the first handle 16 by the ratio of the length of the handle 16 to the distance of the tool 43 or 92 from the fulcrum point. The force applied on the manhole cover by the lifting apparatus 10 disengages the manhole cover from the manhole. The first handle 16 is pivoted downward on the arcuate surface engaging member 20 until the first and second set of wheels 34, 36 are engaging the surface proximate the manhole cover and the surface engaging member 20 is displaced from the surface.

With the manhole cover lifted from the manhole and the first and second sets of wheels 34, 36 contacting the surface proximate the manhole, the user can wheel the manhole cover away from the manhole. Once the manhole cover is in a desired position, the manhole cover is lowered. As the manhole cover is lowered, the surface engaging member 20 contacts the surface and displaces the first and second sets of wheels 34, 36 therefrom. The device is further rotated on the surface engaging member 20 until the manhole cover is resting on the surface. With the manhole cover resting on the surface, the tool 43 or 92 is disengaged from the manhole cover such that the apparatus 10 is able to be used to remove another manhole cover if desired.

Once the work in the manhole has been completed, the lifting apparatus 10 is positioned proximate the manhole cover and the tool 43 or 92 reengages the aperture within the manhole cover. A downward force is applied to the first handle 16 thereby applying the proportionally greater force to the manhole cover which lifts the manhole cover. The downward force is further applied to the first handle 16 until the first and second sets of wheels 34, 36 engage the surface allowing the user to wheel the manhole cover into position over the manhole. The manhole cover is lowered into the manhole until the manhole cover rests within the manhole at which time, the engaging tool 43 or 92 is disengaged from the aperture in the manhole cover.

Although the present invention has been described with reference to preferred embodiments, workers skilled in the art will recognize that changes may be made in form and detail without departing from the spirit and scope of the invention.

What is claimed is:

1. A portable apparatus for removing a manhole cover from a manhole, the manhole cover having an engaging surface, the apparatus comprising:

a leg having a first end and a second end:

a ground engaging member attached to the leg, the ground engaging member having an arcuate configuration;

a shaft having a first end and a second end wherein a first end of the shaft is attached to the first end of the leg wherein the attached first ends of the leg and the shaft define an obtuse angle and wherein the attached first ends of the leg and the shaft provide a fulcrum point for the apparatus; and a tool attached to the second end of the leg wherein the tool engages the engaging surface of the manhole cover.

2. The apparatus of claim 1 wherein the lea further comprises:

a shoulder between the first and second ends; and first and second surfaces defining first and second apertures, wherein the first and second surfaces defining the first and second apertures are aligned.

3. The apparatus of claim 1 wherein the leg further comprises a circular cross section.

4. The apparatus of claim 1 and further comprising a wheel assembly attached to the ground engaging member, the wheel assembly comprising:

a support member attached to the ground engaging member, the support member having a first end and a second end;

a first set of wheels attached to the support member proximate the first end; and a second set of wheels attached to the support member proximate the second end.

5. The apparatus of claim 1 and further comprising a fillet attached to the leg and the shaft at the fulcrum point.

6. The apparatus of claim 1 and further comprising a handle attached to the second end of the shaft wherein the handle is in an orthogonal relationship with the leg.

7. The apparatus of claim 1 wherein the tool comprises:

a support member having a through bore of a complimentary configuration to the leg wherein the support member disposes over the leg and wherein a first end of the support member juxtaposes the shoulder and wherein the support member has first and second aligned apertures such that a pin is disposed through the first and second apertures in the support member and the leg to operably attach the support member to the engaging member; and a U-shaped member attached to the support member at a second end, the U-shaped member having first and second side walls and a web attaching the first and second side walls wherein the web includes a channel extending from the second end and wherein the first and second side walls include first and second aligned slots.

8. The apparatus of claim 7 wherein the tool further comprises:

a chain having a first end and a second end;

a first hook attached to the first end of the chain; and a second hook attached to the second end of the chain wherein the chain is disposed in the first and second aligned slots in the first and second side portions.

9. The apparatus of claim 1 wherein the tool further comprises:

a support member having a through bore of a complimentary configuration to the leg wherein the support member disposes over the leg and wherein a first end of the support member juxtaposes the shoulder and wherein the support member has first and second aligned apertures such that a pin is disposed through the first and second apertures in the support member and the leg to operably attach the support member to the leg by a pin; and an X-shaped member attached to a second end of the support member, wherein each leg of the X-shaped member includes an angled portion at a distal end.

10. A method for lifting a manhole cover from a manhole, the manhole cover having an engaging surface for lifting the manhole cover, the method comprising:

positioning a lifting apparatus, proximate the manhole cover, the lifting apparatus comprising a leg, a shaft attached to a first end of the leg, wherein the attached leg and shaft form an obtuse angle, a ground engaging member attached to a bottom of the leg, and a set of wheels attached to the ground engaging member;

attaching a manhole cover engaging tool to the leg proximate a second end;

pivoting the lifting apparatus in a first direction thereby lowering the manhole cover engaging tool, on the ground engaging member such that the manhole cover engaging tool engages the engaging surface of the manhole cover;

pivoting the lift apparatus on the surface contacting member in a second direction opposite the first direction until the manhole cover engaging tool is secured within the engaging the surface of the manhole cover;

applying a downward force on the shaft which applies an upward force on the manhole cover and lifts the manhole cover;

applying the downward force to the shaft thereby pivoting the lifting apparatus about the ground engaging member until the set of wheels support the lifting apparatus; and wheeling the manhole cover away from the manhole.

11. The method of claim 10 and further comprising pivoting the lifting apparatus about the ground engaging member in the first direction such that the manhole cover is disposed on a surface.

12. The method of claim 11 and further comprising disengaging the lifting apparatus from the manhole cover.

13. The method of claim 12 and further comprising:

re-positioning the lifting apparatus proximate the manhole cover;

pivoting the lifting apparatus on the ground engaging member such that the manhole cover engaging tool is secured within the engaging the surface of the manhole cover;

applying a downward force on the shaft which applies an upward force on the manhole cover and lifts the manhole cover;

applying the downward force to the shaft thereby pivoting the lifting apparatus about the ground engaging member until the set of wheels support the lifting apparatus; and wheeling the manhole cover toward the manhole.

14. The method of claim 13 and further comprising lowering the manhole cover into the manhole.

15. The method of claim 14 and further comprising disengaging the lifting apparatus from the manhole cover.

16. A portable apparatus for removing a manhole cover from a manhole, the manhole cover having an engaging surface, the apparatus comprising:

a leg having a first end and a second end;

a shaft having a first end and a second end wherein a first end of the shaft is attached to the first end of the leg wherein the attached first ends of the leg and the shaft defined an obtuse angle and wherein the attached first ends of the leg and the shaft provide a fulcrum point for the apparatus;

a fillet attached to the leg and the shaft at the fulcrum point; and a tool attached to the second end of the leg wherein the tool engages the engaging surface of the manhole cover.

17. The apparatus of claim 16 wherein the leg further comprises:

a shoulder between the first and second ends; and first and second surfaces defining first and second apertures, wherein the first and second surfaces defining the first and second apertures and aligned.

18. The apparatus of claim 16 and further comprising:

a ground engaging member having a first end and a second end attached to the leg, the ground engaging member having an arcuate configuration;

a first set of wheels attached to the ground engaging member proximate the first end; and a second set of wheels attached to the ground engaging member proximate the second end.

19. The apparatus of claim 16 and further comprising a handle attached to the second end of the shaft wherein the handle is in an orthogonal relationship with the leg.

20. The apparatus of claim 16 wherein the tool comprises:

a support member having a through bore of a complimentary configuration to the leg wherein the support member disposes over the leg and wherein a first end of the support member juxtaposes the shoulder and wherein the support member has first and second aligned apertures such that a pin is disposed through the first and second apertures in the support member and the leg to operably attach the support member to the engaging member; and a U-shaped member attached to the support member at a second end, the U-shaped member having first and second side walls and a web attaching the first a second side walls wherein the web includes a channel extending from the second end and wherein the first and second side walls include first and second aligned slots.

21. The apparatus of claim 20 wherein the tool further comprises:

a chain having a first end and second end;

a first hook attached to the first end of the chain; and a second hook attached to the second end of the chain wherein the chain is disposed in the first and second aligned slots in the first and second side portions.

22. The apparatus of claim 16 wherein the tool further comprises:

a support member having a through bore of a complimentary configuration to the leg wherein the support member disposes over the leg and wherein a first end of the support member juxtaposes the shoulder and wherein the support member has a first and second apertures in the support member and the leg to operably attach the support member to the leg by a pin; and an X-shaped member attached to a second member includes an angled portion at a distal end.

* * * * *

UNITED STATES PATENT AND TRADEMARK OFFICE

CERTIFICATE OF CORRECTION

PATENT NO. : 6,520,482 B1
DATED : February 18, 2003
INVENTOR(S) : Vern Bigham

It is certified that error appears in the above-identified patent and that said Letters Patent is hereby corrected as shown below:

Column 7,
Line 5, delete ":", insert -- ; --
Line 17, delete "lea", insert -- leg --

Column 9,
Line 9, delete "defined", insert -- define --
Line 24, delete "apertures and aligned", insert -- apertures are aligned --

Column 10,
Line 13, delete "first a second", insert -- first and second --
Line 34, after "second", insert -- end of the support member, wherein each leg of the X-shaped --

Signed and Sealed this

Nineteenth Day of August, 2003

JAMES E. ROGAN
*Director of the United States Patent and Trademark Office*